US007066088B2

(12) United States Patent
McLean et al.

(10) Patent No.: US 7,066,088 B2
(45) Date of Patent: Jun. 27, 2006

(54) VARIABLE CUT-OFF OFFSET PRESS SYSTEM AND METHOD OF OPERATION

(75) Inventors: Michael Edward McLean, Etowah, NC (US); Robert Stephen Erbstein, Naples, FL (US); Lief Frederick Reslow, East Greenwich, RI (US)

(73) Assignee: Day International, Inc., Arden, NC (US)

( * ) Notice: Subject to any disclaimer, the term of this patent is extended or adjusted under 35 U.S.C. 154(b) by 345 days.

(21) Appl. No.: 10/208,997

(22) Filed: Jul. 31, 2002

(65) Prior Publication Data

US 2004/0020382 A1 Feb. 5, 2004

(51) Int. Cl.
*B41F 5/16* (2006.01)

(52) U.S. Cl. ..... 101/177; 101/217

(58) Field of Classification Search ..... 101/142, 101/171, 174, 177, 183, 216, 217; 347/103
See application file for complete search history.

(56) References Cited

U.S. PATENT DOCUMENTS

| | | | | |
|---|---|---|---|---|
| 3,263,606 A | | 8/1966 | Poynter | |
| 4,522,491 A | | 6/1985 | Ingalls et al. | |
| 5,394,798 A | | 3/1995 | Simon et al. | |
| 5,813,336 A | | 9/1998 | Guaraldi et al. | |
| 5,950,536 A | | 9/1999 | Erbstein | |
| 6,196,675 B1 | * | 3/2001 | Deily et al. | 347/103 |
| 6,205,921 B1 | | 3/2001 | Dzierzynski et al. | |
| 6,244,176 B1 | | 6/2001 | Sonobe et al. | |
| 6,386,697 B1 | * | 5/2002 | Yamamoto et al. | 347/103 |
| 6,494,570 B1 | * | 12/2002 | Snyder | 347/103 |
| 2003/0041767 A1 | | 3/2003 | Douillard et al. | |

FOREIGN PATENT DOCUMENTS

| | | | |
|---|---|---|---|
| CA | 2224762 | | 7/1999 |
| GB | 923 405 A | | 4/1963 |
| JP | 11-224008 | * | 8/1999 |
| WO | WO 83 00653 A | | 3/1983 |

* cited by examiner

*Primary Examiner*—Ren Yan
(74) *Attorney, Agent, or Firm*—Dinsmore & Shohl LLP

(57) ABSTRACT

A variable cut-off offset press system and method of operation which utilizes a continuous image transfer belt is provided. The offset printing system comprises at least two plate cylinders adapted to have thereon respective printing sleeves. Each of the printing sleeves is adapted to receive colored ink from a respective ink source. An optional coating source may be provided to fully or partially coat the image transfer belt before inking. The system further comprises at least a impression cylinder, wherein the image transfer belt is positioned to contact each of the printing sleeves at respective nips formed between respective ones of the plate cylinders and the at least one impression cylinder. An image belt cleaning station adapted to remove residual ink or coating from the surface of the image transfer belt after image transfer of a multicolored image from the image transfer belt to a substrate is also provided.

29 Claims, 3 Drawing Sheets

VARIABLE CUT-OFF OFFSET PRESS SYSTEM AND METHOD OF OPERATION

BACKGROUND OF THE INVENTION

This invention relates to a variable cut-off offset press system and method of operation, and more particularly to such a system which utilizes a continuous image transfer belt.

Commercial printers have used a variety of different printing techniques such as gravure printing, flexographic printing, and offset printing. Each of these techniques basically involves the step of inking a plate containing an image to be printed and transferring the ink (which now represents an image) onto a substrate such as, for example, paper, cardboard, film, and foil.

A typical single color offset printing press includes a plate cylinder, a blanket cylinder, and an impression cylinder, each rotationally mounted on the press. Four-color presses require individual print stations with plate, blanket, and impression cylinders for each color. The plate cylinder carries a printing plate having a surface defining an image to be printed. The blanket cylinder carries a printing blanket having a flexible surface which contacts the printing plate at a nip between the plate cylinder and the blanket cylinder. The substrate to be printed, typically in the form of a continuous web or cut-sheet, travels through a second nip between an impression cylinder and the blanket cylinder.

The ink, which is required to form the image on the substrate, is first applied to the plate cylinder, transferred to the blanket cylinder at the nip there between, and then transferred to the material to be printed at the second nip. Simultaneous printing on both sides of the substrate is also possible by providing another assembly formed by another plate cylinder and another blanket cylinder on the opposite side of the substrate.

The length of the surface of the blanket cylinder (or the circumference thereof), including the printing blanket, is designed to be a multiple (typically one) of the length of the surface of the plate cylinder (of the circumference thereof), including the plate. However, should a customer require a printed image falling outside of this parameter either the press operator would not be able to print such an image with the existing press, or the print job would result in a sizable portion of substrate being wasted. For example, if the blanket circumference is less than the length of the image to be printed, the press is incapable of printing the job. Conversely, if the length of the blanket is 1.5 times the length of the image to be printed, a substantial portion of the blanket (and the underlying substrate) will receive no inked image.

Press manufacturers have developed what is termed a "variable cut-off" press to address this problem. Fixed cutoff press equipment can be made obsolete by customers changing to product sizes which do not fit the present equipment. Customers are showing an increased interest in a range of sizes to be printed. This trend may be the result of the digitization of pre-press operations.

In any event, should a printer want to accommodate print runs of different lengths, the printer can equip himself with custom presses having those cut-offs (i.e., diameters or circumferences) which are most likely to be ordered. Such a strategy is quite expensive. Other alternatives have been developed. For example, presses having removable cassettes have been introduced, such as the offset printing press described in U.S. Pat. No. 5,394,798 to Simon et al. Such a press includes both the plate cylinder and the blanket cylinder of the appropriate cutoff in a removable, replaceable cassette unit. The disadvantage of this type of press is that the cost of a cassette is approximately half that of a new printing unit and requires a considerable amount of downtime in order to change the cassette and perform the necessary adjustments to adapt to a new print job.

Converting a typical commercial offset press system to variable cut-off operation further requires variable cut-off print units and folders. A recent advancement in offset printing has been the development of a gapless blanket. Traditionally, printing blankets were formed as flat sheets which were subsequently wrapped around the blanket cylinder. The blanket cylinder required a longitudinal gap where the two opposite ends of the flat sheet met so that the blanket could be properly mounted and tensioned. Such a gap caused vibration and other problems associated with high-speed printing.

Accordingly, gapless blankets have been developed, such as, for example, the blanket described in Gaffney et al, U.S. Pat. No. 5,429,048. Such gapless blankets purport to minimize the vibrations associated with high-speed printing and are essentially relatively flexible hollow members which can be fitted onto the blanket cylinder. Typically, air passages are provided in the blanket cylinder to enable air pressure to be applied to the gapless sleeve for mounting and demounting thereof.

Other variable cut-off offset presses have been developed based on the use of gapless printing blanket sleeves. For example, Guaraldi et al, U.S. Pat. No. 5,813,336, teaches a press unit having axially removable printing and blanket sleeves. In order to provide a variable cut-off capability for the press, the print and impression cylinders are provided with so-called "saddles" which have a common inner diameter for mounting, but have a variety of outer diameters to accommodate print jobs of varying lengths. The printing plate and blanket sleeves are then mounted over the "saddles" to provide for variable cut-off printing. However, the diameters of the plate and blanket sleeves must be changed in tandem. Otherwise, residual ink on the blanket sleeve will be out of registration with each succeeding rotation and may print as a ghost image onto succeeding portions of the substrate.

Another approach to variable cut-off offset printing is taught by Erbstein, U.S. Pat. No. 5,950,536. There, a printing unit is provided with a plate cylinder and variable diameter plate cylinder sleeves which can be mounted and unmounted as required. In order to accommodate the variable diameters for the printing sleeves, the printing impression cylinder is adapted to be laterally movable. However, because the print and blanket sleeve diameters may be mismatched, the press requires either a very high ink transfer ratio between the blanket and the substrate, or blanket cleaning after each rotation to avoid residual ink on the blanket from transferring onto the substrate.

Yet, another approach to variable cut-off printing is described in U.S. patent application Ser. No. 09/159,662, filed Sep. 24, 1998, entitled CONTINUOUS IMAGE TRANSFER BELT AND VARIABLE SIZE OFFSET PRINTING SYSTEM. In this system, a continuous image transfer belt having a greater circumference than the circumference of the printing plate cylinder is used to transfer inked images onto a substrate. Simply by changing the diameter of the plate cylinder, the length of the printed image may be changed. A cleaning station is provided to remove residual ink from the belt prior to re-inking the belt.

However, problems remain in the art, particularly in obtaining precise image registration with four-color printing presses. One problem continues to be that the dimensions of the substrate change from print station to print station as the water-based inks at each print station wet the paper substrate which is driven under tension. Other problems include the need to clean the blanket surface to remove residual ink in some systems. Accordingly, the need still exists in the art for a variable cut-off offset printing system which provides precise registration of the inked images and which can be readily adapted for different sized print jobs. A need also exists for a variable cut-off offset printing system which does not require blanket cleaning to remove residual ink.

SUMMARY OF THE INVENTION

The present invention meets those needs by providing a variable cut-off offset press system and method of operation which utilizes a continuous image transfer belt. In accordance with one aspect of the present invention, an offset printing system is provided. The system comprises at least two sources of ink having at least first and second different colors, at least two plate cylinders adapted to have thereon a respective printing plate, each of the respective printing plates adapted to receive ink from respective ones of the ink sources, and at least two impression cylinders. In a preferred embodiment, four plate cylinders, plates, and corresponding impression cylinders are provided to effect four color offset printing.

The system also comprises an image transfer belt positioned to contact each of the printing plates at respective nips formed between respective ones of the plate cylinders and the impression cylinders and to receive in registration at least first and second inked images from the printing plates to form a multicolored image. An image transfer belt tensioning system adapted to register the image transfer belt to respective ones of the impression cylinders is positioned in the area of desired image transfer, with the image transfer belt tensioning system including a drive. An image belt cleaning station adapted to remove residual ink from the surface of the image transfer belt after image transfer of the multicolored image from the image transfer belt to a substrate is also provided. If desired, a coating station adapted to apply a film of a coating material to the image transfer belt may also be provided.

Preferably, the belt tensioning system comprises a plurality of tensioning rolls about which the image transfer belt is driven. At least one of the tensioning rolls is temperature controlled. Optionally, the system also comprises a sensing device for sensing the position of the image transfer belt.

In its preferred form, the image transfer belt is continuous and comprises at least one base ply, at least one layer of a compressible material over the base ply, and a surface ply over the layer of compressible material. The base ply preferably comprises a reinforcement material, and the reinforcement material comprises a woven fabric ply.

To aid in smooth operation of the system, the woven fabric ply is rigid in a direction across the width of the belt and flexible along the longitudinal axis of the belt. The base ply also preferably comprises an inner surface which is capable of providing precise registration, such as, for example, where the inner surface comprises a high friction material.

To provide a variable offset capability to the system, the plate cylinders are preferably adapted to receive replaceable sleeves. The replaceable sleeves are designed to have common inner diameters to fit over the plate cylinders but have different outer diameters to permit the printing of different sized images.

In another aspect of the invention, a method of printing with an offset printing system is provided and comprises forming first and second inked images of different colors, and offsetting the first and second inked images to the surface of an image transfer belt in registration with each other to form a multicolored image. The method further comprises offsetting the multicolored image from the image transfer belt to a substrate, and removing residual ink from the image transfer belt at an image belt cleaning station prior to re-inking.

Preferably, the first and second inked images are formed by providing a first ink having a first color to a plate cylinder having a replaceable sleeve having a printing plate thereon, with the printing plate adapted to receive the first ink to form a first inked image. A second ink having a second color is provided to a plate cylinder having a replaceable sleeve having a printing plate thereon, with the printing plate adapted to receive the second ink to form a second inked image. The image transfer belt is positioned around an impression cylinder, with the image transfer belt having a circumference greater than the circumference of the impression cylinder. The system comprises an image transfer belt tensioning system to register the image transfer belt to the impression cylinder in the area of desired image transfer.

In operation, a substrate such as, for example, a continuous web or cut-sheets of paper is printed on by repetitively forming the first and second inked images, and repetitively offsetting the first and second inked images to the surface of the image transfer belt to form a multicolored image. Next, the multicolored image is repetitively offsetted to and from the image transfer belt and to the substrate. Optionally, a film of transparent polymeric material may be repetitively formed on the surface of the image transfer belt before laying the inked images to provide a coating to the resulting printed image on the substrate.

In a preferred form, the first and second inked images are formed by providing a first ink having a first color to a plate cylinder having a replaceable sleeve having a printing plate thereon. The printing plate is adapted to receive the first ink to form a first inked image. A second ink is provided having a second color to a plate cylinder having a replaceable sleeve having a printing plate thereon, the printing plate adapted to receive the second ink to form a second inked image. The image transfer belt is positioned around a impression cylinder, with the image transfer belt having a circumference greater than the circumference of the impression cylinder and including an image transfer belt tensioning system to register the image transfer belt to the impression cylinder in the area of desired image transfer.

Again, in a preferred form, the system is adapted to print variable sized images by replacing the replaceable sleeves with other sleeves having a different outer diameter than the previous sleeves and repetitively offsetting inked images of a different size to and from the image transfer belt and to the substrate.

In accordance with yet another embodiment of the invention, provided is an offset printing system comprising a source of ink, a source of a transparent polymeric material, and at least one plate cylinder adapted to have thereon a printing plate. The printing plate is adapted to receive ink from the ink source to form an inked image, and at least one impression cylinder. The system also comprises an image transfer belt positioned to receive a film of transparent polymeric material from the source of transparent polymeric material and to contact the printing plate in a nip formed between the plate and impression cylinders such that the inked image offsets onto the film. An image transfer belt tensioning system is adapted to register the image transfer belt to the impression cylinder positioned in the area of desired image transfer. The image transfer belt tensioning system includes a drive. The image transfer belt and belt tensioning system are as described above.

The above-described embodiments of the invention may further be adapted to provide dual-sided offset printing. In this embodiment, the offset printing system further comprising a second source of ink, a second source of a transparent polymeric material, and a second plate cylinder adapted have thereon a second printing plate, the second printing plate adapted to receive ink from the second ink source to form an inked image. This embodiment further comprises a second impression cylinder, and a second image transfer belt positioned to receive a film of transparent polymeric material from the source of transparent polymeric material and to contact the second printing plate in a nip formed between the second printing plate and the second impression cylinder, such that the inked image offsets to the film.

The above described dual-sided offset printing system further comprises a second image transfer belt tensioning system adapted to register the second image transfer belt to the second impression cylinder positioned in the area of desired image transfer. The second image transfer belt tensioning system comprises a second drive, and the area of desired image transfer is in opposition to the first image transfer belt to effect two-sided printing of a moving substrate. In a preferred form, this embodiment is also adapted to print variable sized images by providing plate cylinders which are adapted to receive replaceable sleeves, the sleeves having a number of different outer diameters.

In a preferred form, the method comprises providing a transparent polymeric material to the surface of an image transfer belt to form a film of the transparent polymeric material thereon, and forming an inked image. The inked image is offsetted to the surface of an image transfer belt in registration with the film of the transparent polymeric material, wherein the inked image and the film of the transparent polymeric material are offsetted from the image transfer belt to a substrate. Again, the system is adapted to provide variable cut-off printing of images by providing plate cylinders having replaceable sleeves. By replacing the replaceable sleeve with another sleeve having a different outer diameter, inked images of a different size are repetitively offset to and from the image transfer belt and to the substrate.

Accordingly, it is a feature of the present invention to provide a variable cut-off offset press system and method of operation which utilizes a continuous image transfer belt. These, and other features and advantages of the present invention will become apparent from the following detailed description, the accompanying drawings, and the appended claims.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1A:
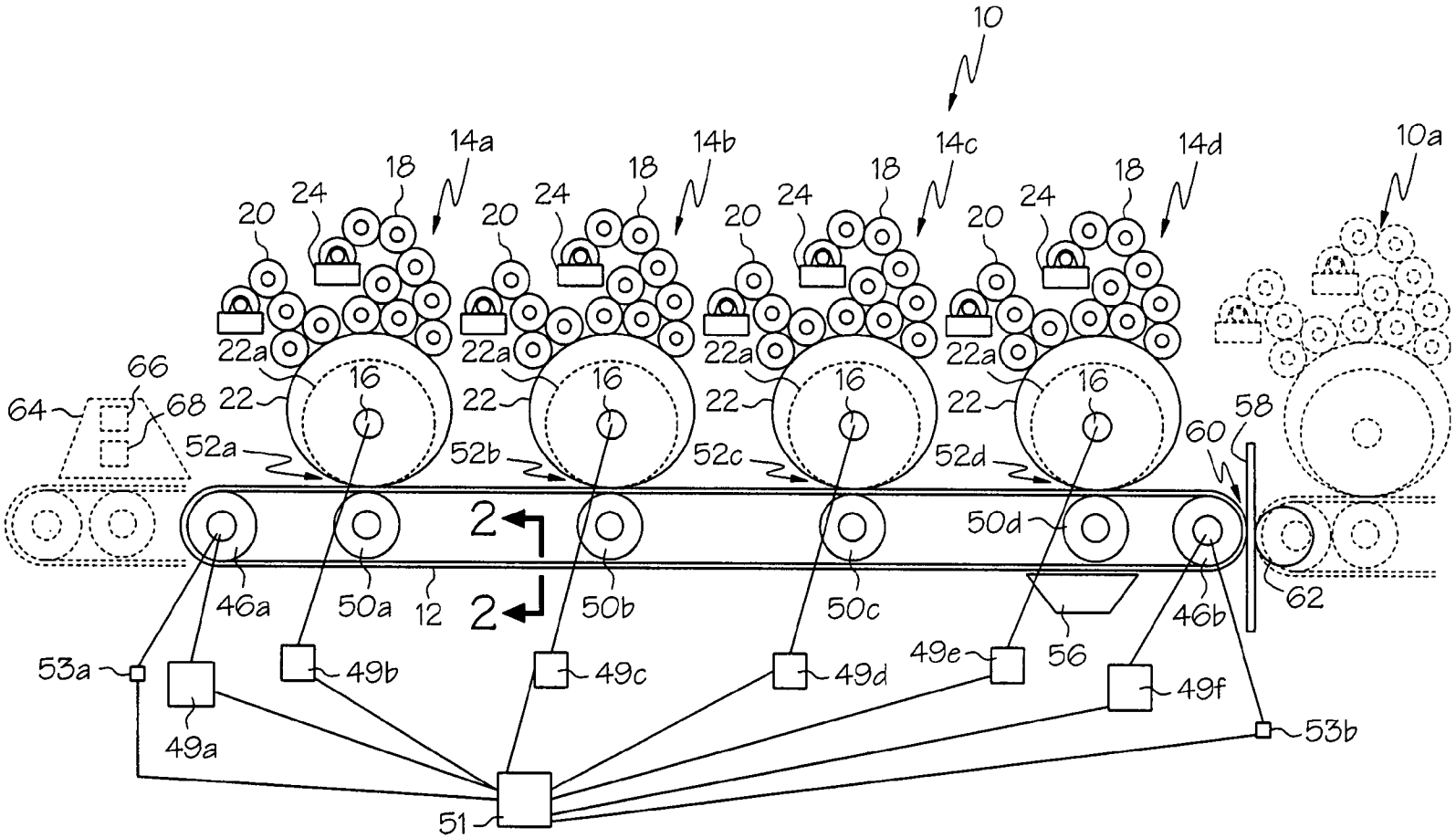
FIGS. 1A and 1B are diagrammatic views of an apparatus according to typical embodiments of the present invention; and, FIG. 2 is an enlarged fragmentary section through the image transfer belt along section line 2—2 illustrating a typical interior construction which can be employed.
Figure 1B:
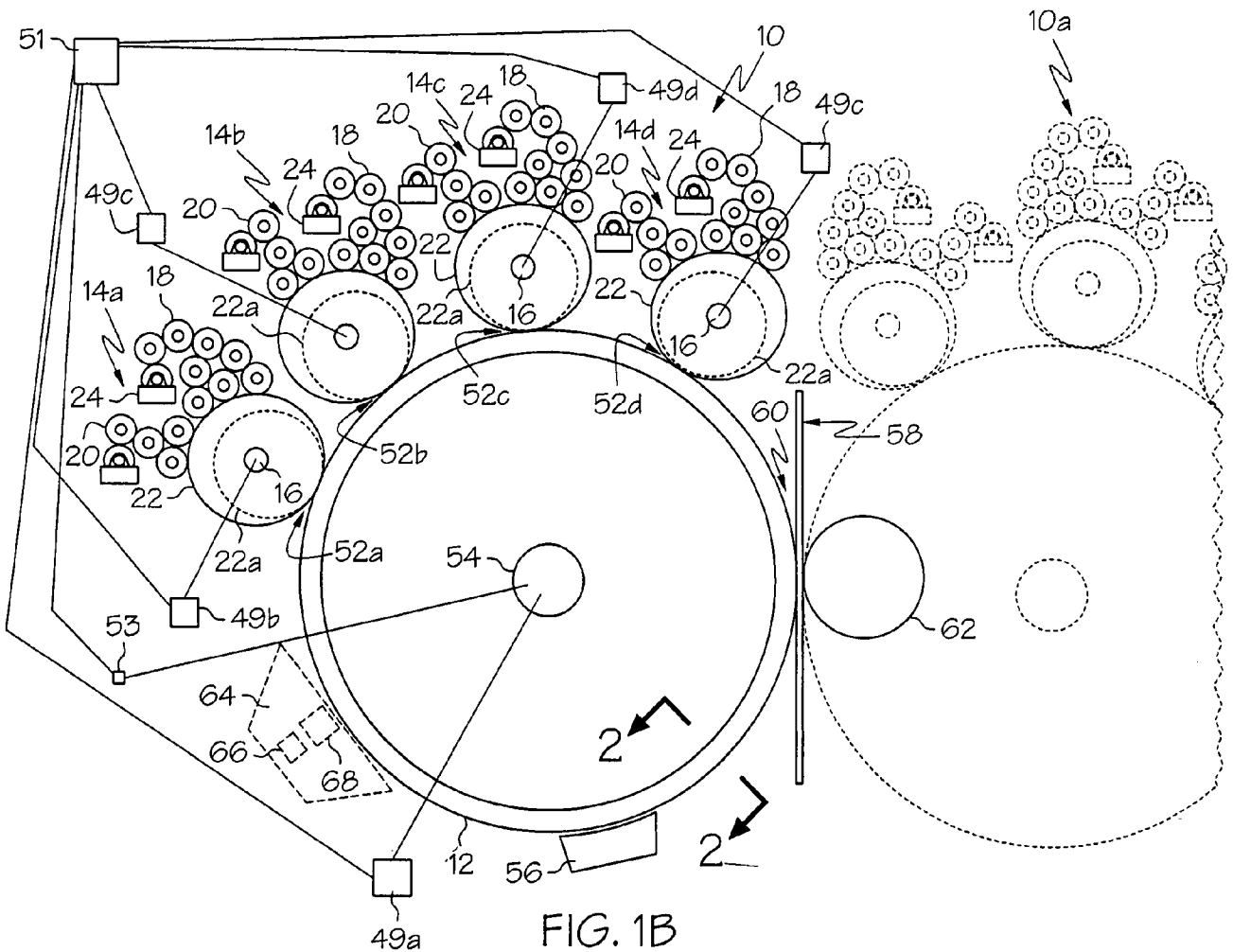

FIGS. 1A and 1B illustrate generally two embodiments of a variable cut-off offset pressing apparatus 10 and method of operation which utilize a continuous image transfer belt 12 in accordance with the present invention. In both embodiments, the apparatus 10 is intended primarily for printing on paper stock, but may be used for printing on other types of stock material. It is to be appreciated that since both embodiments shown in FIGS. 1A and 1B are essentially the same, like components are indicated with the same numeral.

Generally, to both embodiments, the apparatus 10 includes a series of image transfer stations 14*a*, 14*b*, 14*c*, and 14*d* arranged in a generally linear or arcuate configuration. However, it should be readily understood by one of ordinary skill in the art, that the image transfer stations 14*a*–*d* do not necessarily need to be arranged in a uniform linear or arcuate configuration as shown.

Each of the image transfer stations 14*a*–*d* is provided with a plate cylinder 16, a series of inking rollers 18, and a series of damping rollers 20 in a manner that is conventional to the art. Should the apparatus 10 be utilized for waterless printing then series of damping rollers 20 would not be required as is generally known in the art. Additionally, the image transfer stations 14*a*–*d* may be thermostatically controlled and connected to a cooling system (not shown) in order to provide the optimum temperature range for waterless printing.

Each of the plate cylinders 16 has a specific diameter to facilitate printing of an image of a particular dimension as is known in the art. However, the advantage of the apparatus 10 of the present over the prior art is that each of the print cylinders 16 is adapted to receive a printing sleeve 22, which is replaceable with a sleeve 22*a* having a different diameter. Utilizing replaceable printing sleeves 22 and 22*a* enable the effective length of the printing plate to be readily modified by changing its circumference when mounted on the plate cylinder. Accordingly, printing full color images of various dimensions may be easily facilitated by using a set of sleeves having the appropriate diameter without having to change out or modify any other components in the apparatus 10.

Continuing, an ink reservoir 24 is provided to each of the image transfer stations 14*a*–*d* supplying a source of a preselected color ink to the printing sleeves 22, which are adapted to receive the ink, via the inking rollers 18. It should be apparent to those skilled in the art that the apparatus 10 of the present may be used with a variety of inks such for example as waterbased inks, UV inks, and waterless inks.

The image transfer stations 14*a*–*d* are rotated by a drive unit in a manner that is conventional in the art. Additionally, the image transfer stations 14*a*–*d* are essentially identical with the only difference among the image transfer stations being the positions thereof and the use of different colored inks. For clarity, the components of only one image transfer station 14*a* will be described herein with the understanding that the remaining image transfer stations comprise the same components.

Figure 2:
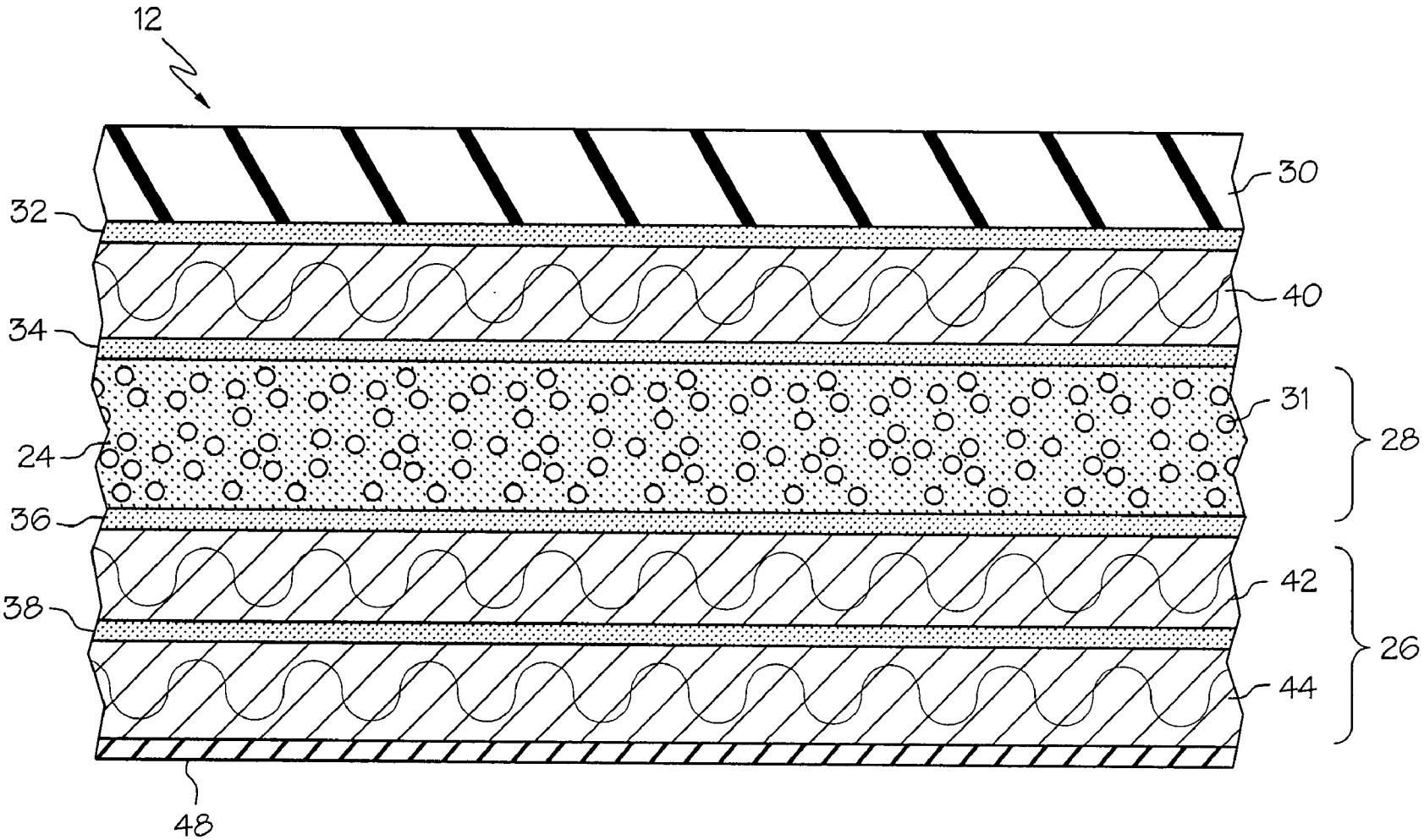

The image transfer belt 12 is a continuous and gapless belt and which is adapted to permit the press system to print a variety of different sized printed matter. The image transfer belt 12 may be any continuous, gapless belt that is conventional in the art, but preferably is a layered construct, such as that shown in FIG. 2. FIG. 2 is an enlarged fragmentary section through the image transfer belt 12 along section line 2—2 in FIGS. 1A and 1B illustrating a typical interior construction which can be employed.

Preferably, the belt 12 comprises at least one base ply 26, at least one compressible layer 28 over the base ply 26, and a surface ply 30 over the compressible layer 28. The surface ply 30 is an elastomer material, such as rubber, as is conventional in the art. Preferably, the compressible layer 28 comprises an elastomer material 29 having voids or microspheres 31 distributed substantially uniform throughout the layer.

Adhesive layers 32, 34, 36, and 38 are preferred to ensure sufficient bonding between the different plies of the belt 12. Reinforcing plies 40, 42, and 44 are preferably formed of woven or nonwoven fabric. Typically, the fabric is selected from high-grade cotton yarns, which are free of slubs and knots, rayon, nylon, polyesters, or mixtures thereof. However, it is to be appreciated that the reinforcement fabric is designed to be rigid in a direction across the width of the belt 12 and flexible along the longitudinal axis of the belt 12.

Accordingly, the image transfer belt 12 of the present invention has numerous advantages including the ability to print images of varying sizes without complicating the design of the press. Further, the belt has a useful life which is greater than a standard printing blanket or printing sleeve because it is a multiple of the length of a standard blanket. Thus, the belt 12 reduces down time and labor costs because it does not need to be replaced as often as a standard blanket or sleeve.

Turning now to FIG. 1A, provided specific to this embodiment is at least a pair of tension rollers 46*a* and 46*b*, around which the image transfer belt 12 is situated. In this illustrative embodiment, the base ply 26 of the image transfer belt 12 may be provided over a friction-enhancing layer 48 (FIG. 2) to minimize slippage between the belt 12 and the tension rollers 46*a* and 46*b*. A conventional drive unit (not shown) may drive any combination of the tension rollers 46*a* and 46*b*, thereby driving the belt 12. Alternatively, a separate belt drive unit may be use if desired. Additionally, the tension rollers 46*a* and 46*b* may be temperature controlled in order to minimize contraction and expansion of the image transfer belt 12.

Positioned between the tension rollers 46*a* and 46*b*, is a series of impression cylinders 50*a*, 50*b*, 50*c*, and 50*d*. It is to be appreciated that each of the impression cylinders 50*a–d* is provided to one of the image transfer stations 14*a–d*, respectively, on the opposite side of the image transfer belt 12 thereof. Accordingly, the image transfer stations 14*a–d* and their respective impression cylinders 50*a–d* together form a series of transfer nips 52*a–d*. At each transfer nip 52*a*, 52*b*, 52*c*, and 52*d* the image transfer belt 12 makes contact with the respective printing sleeve 22 of each image transfer station 14*a*, 14*b*, 14*c*, and 14*d*.

For registration, a conventional sensor system such as, for example, encoders, light diodes, and the like may be used for monitoring the movement of the image transfer belt 12. Alternatively, the image transfer belt itself may be provided with encoder slots, bar codes, and/or interior layers that are capable of providing precise registration, such as for example, a magnetic signature. Preferably, an encoder 49*a*, 49*b*, 49*c*, 49*d*, 49*e*, and 49*f* is coupled to each of the tension rollers 46*a* and 46*b*, and to each of the image transfer stations 14*a–d*. The signals from the encoders 49*a–f* are then delivered to a computer 51 for processing in order to assist in the timing of the transferring of a color image portion from each image transfer station 14 to the image transfer belt 12.

Accordingly, tension rollers 46*a* and 46*b*, the encoders 49*a–f*, and the computer 51 form a tensioning system which is adapted to register the image transfer belt 12 with one of the impression cylinders 50*a–d* positioned in the area of the desired image transfer station 14. Additionally, temperature sensors 53*a* and 53*b* may be provided to each of the tension rollers 53*a* and 53*b*, respectively. The signals from the temperature sensors 53*a* and 53*b* are then sent to the computer 51 which is adapted to provide temperature control of the tensioning rollers 46*a* and 46*b* to minimize dimensional changes to the image transfer belt 12.

In the embodiment illustrated by FIG. 1B, the image transfer belt 12 is mounted to a single blanket roller 54. As with the previous embodiment, transfer nips 52*a–b* are formed in the contact area between the image transfer belt 12 and the printing sleeve 22 of each image transfer station 14. The only difference is in this embodiment the contact areas between the image transfer belt 12 and each printing sleeve 22 are facilitated with the single impression cylinder 54, versus the multiple impression cylinders 50*a–d* of the previous embodiment.

For registration, as with the previous embodiment, a conventional sensor system, such as for example encoders, light diodes, and the like may be used for monitoring the movement the image transfer belt 12. Alternatively, the image transfer belt itself may be provided with encoder slots, bar codes, and/or interior layers that are capable of providing precise registration, such as for example, a magnetic signature. Preferably, an encoder 49*a*, 49*b*, 49*c*, 49*d*, and 49*e* is coupled to the blanket roller 54 and to each of the image transfer stations 14*a–d*.

The signals from the encoders 49*a–e* are then delivered to a computer 51 for processing in order to assist in the timing of the transferring of a color image portion from each image transfer station 14 to the image transfer belt 12. Additionally, in this embodiment a temperature sensor 53 may be provided to the blanket roller 54. The signal from the temperature sensor 53 is sent to the computer 51 which is adapted to provide temperature control of the blanket roller 54 to minimize dimensional changes to the image transfer belt 12.

Finally, to both embodiments a cleaning station 56 is provided, which completely cleans the image transfer belt 12 of any residual material, such as ink and/or coating material left over after a single printing pass or revolution. In this manner, each time an image is transferred to the image transfer belt 12, the image goes on a cleaned or conditioned belt surface.

OPERATION

Referring again to FIGS. 1A and 1B, to print a full color picture, an appropriate plate image provided on the first printing sleeve 22 of the first plate cylinder 16 takes up a first color ink and transfers it to the image transfer belt 12 at the first image transferring nip 52*a*. For full color printing colored inks such as black, cyan, magenta and yellow are typically used. It should be understood by those persons skilled in the related art that the order of application of colors is immaterial, but typically cyan, magenta, yellow and black.

In operation, the plate cylinders 16 of the individual image transfer station 14 are driven at a speed such that the printing sleeves 22 match the speed of the image transfer belt 12. Matching the speed of the image transfer belt ensures proper transfer of the image portion from each printing sleeve 22. As the first color portion of the image is being transferred to the moving image transfer belt 12 at the first transfer nip 52*a*, the second printing sleeve 22 of the second plate cylinder 16, having an appropriate plate image thereon, takes up a second color ink. The second printing sleeve 22 starts transferring the second color portion to the image transfer belt 12 when the first color image enters the second nip 52*b*.

Meanwhile, as the second color image portion is being transferred to the image transfer belt 12 in proper registration with the first color portion, the third printing sleeve 22 of the third plate cylinder 16, having an appropriate plate image thereon, picks up a third color ink. The third printing sleeve 22 starts transferring the third color image portion to the image transfer belt 12 when the multicolor image portion enters the third nip 52*c*.

Meanwhile, as the third color image portion is being transferred to the image transfer belt 12 in proper registration with the multicolored image portion, the fourth printing sleeve 22 of the fourth plate cylinder 16, having an appropriate plate image thereon, picks up a fourth color ink. As the multicolor image portion enters the fourth transfer nip 52*d*, the fourth printing sleeve 22 transfers the fourth color portion of the picture to the image transfer belt 12 in proper registration.

At the exit of the fourth transfer nip 52*d*, the image transfer belt 12 carries a full color image with the ink colors in registration. Meanwhile, a substrate 58 such as, for example, a continuous web or a cut-sheet drawn from a supply (not shown), is put under tension and centered in a manner that is conventional to the art. The substrate 58 is then drawn at a constant speed, which is also controlled by the computer, through a printing nip 60 formed between the image transfer belt 12 and an impression roller 62.

It is to be appreciated that the particular impression roller pressure required for satisfactory printing varies with the width of the substrate used. Printing widths can vary considerably, with the typical range being from about 4 to about 80 inches (about 10 to about 203 centimeters). For a substrate 58 with a wider width, increased impression roller pressure is required. Additionally, the speed of the substrate 58 can be adjusted for different printing operations.

As the substrate 58 is fed through the printing nip 60, the full color image is transferred to the moving substrate at the printing nip. Accordingly, having a continuous image transfer belt reduces registration errors, since the position of the imaged area on the image transfer belt can be more accurately determined and, therefore, the timing for transferring images of different colors from the series of image transfer stations can be more accurately achieved. Additionally, registration errors between the image transfer belt and the substrate are also greatly reduced since only a single multicolor image is transferred onto the substrate at the printing nip.

The impression roller 62 may be replaced with an additional printing apparatus 10*a*, indicated by dash lines, if two-sided printing of the substrate 58 is desired. Such additional apparatus is identical in construction and operation to the previously described apparatus 10. Furthermore, an additional coating station 64, indicated by dashed lines (FIGS. 1A and 1B), may be optionally provided if it is desired to provide a coating material.

The coating material may include, for example, and not limited to, a transparent protective (polymeric) covering material, a tarnishing/antiquing material, and/or other desirable coating materials to provide protection and/or a visual effect to the printed image on the substrate 58. The coating material can be provided in either a solid film or a liquid form. However, if so desired, preferably a liquid polymer supply 66 is provided before the series of image transfer stations 14*a–d*.

The polymer may be carried in a solvent or may be applied as a 100% solid material, which is curable by heat or radiation. In this manner, via a delivery system 68, a polymer film is laid down onto the image transfer belt 12 before the color image transfer stations 14. Either the polymer may be applied as a full coating or a partial coating provided only in those areas where the inked image will be applied.

The printing process then continues as described above; except that the full-color printed image will be protected under a transparent layer when transfer to the substrate 58 at the printing nip 60. This particular embodiment of the invention also eliminates the need for cleaning station 56 because the transparent polymer film and imaged image will be offset onto the substrate 58.

Having described the invention in detail and by reference to preferred embodiments thereof, it will be apparent that modifications and variations are possible without departing from the scope of the invention defined in the appended claims.

What is claimed is:

1. An offset printing system for printing onto a substrate, said offset printing system comprising:

a) at least two sources of ink having at least first and second different colors;

b) at least two plate cylinders each providing a printing plate adapted to receive ink from one of said at least two sources of ink;

c) at least two impression cylinders;

d) an image transfer belt positioned to contact each of said printing plates at respective nips formed between respective ones of said plate cylinders and said impression cylinders and to receive in registration at least first and second inked images from said printing plates to form a multi-colored image on a first side of said image transfer belt;

e) an image transfer belt tensioning system adapted to register said image transfer bell to respective ones of said impression cylinders positioned in the area of desired image transfer; and f) a coating station adapted to apply a coating material to said first side of said image transfer belt, said coating material being transferable with said multi-colored image from said image transfer belt onto the substrate to provide protection or a desired finishing to said multi-colored image.

2. An offset printing system as claimed in claim 1 further comprising a sensing device for sensing the position of said image transfer belt.

3. An offset printing system as claimed in claim 1 wherein said image transfer belt comprises at least one base ply, at least one layer of a compressible material over said base ply, and a surface ply over said layer of compressible material.

4. An offset printing system as claimed in claim 3 wherein said image transfer belt is continuous.

5. An offset printing system as claimed in claim 3 wherein said base ply comprises a reinforcement material.

6. An offset printing system as claimed in claim 5 wherein said reinforcement material comprises a woven fabric ply.

7. An offset printing system as claimed in claim 6 wherein said woven fabric ply is rigid in a direction across the width of said belt and flexible along the longitudinal axis of said belt.

8. An offset printing system as claimed in claim 3 wherein said base ply includes an inner surface which is capable of providing precise registration.

9. An offset printing system as claimed in claim 8 wherein said inner surface comprises a high friction material.

10. An offset printing system as claimed in claim 1 further comprising an image belt cleaning station adapted to remove residual material from the surface of said image transfer belt after image transfer of said multi-colored image from said image transfer belt to a substrate.

11. An offset printing system as claimed in claim 1 wherein each of said at least two plate cylinders is adapted to have thereon a respective replaceable sleeve.

12. An offset printing system as claimed in claim 11 wherein each of said at least two impression cylinders have an outer diameter unequal to an outer diameter of said respective replaceable sleeve.

13. An offset printing system as claimed in claim 1, wherein said image transfer belt tensioning system comprises tension rollers, and at least one of said tension rollers is temperature controlled to minimize contraction and expansion of said image transfer belt.

14. An offset printing system for printing onto a substrate, said offset printing system comprising:

a) a source of ink;

b) a source of a coating material;

c) at least one plate cylinder adapted to have thereon a replaceable sleeve providing a printing plate, said printing plate adapted to receive ink from said ink source to form an inked image;

d) at least one impression cylinder;

e) an image transfer belt positioned to receive a film of coating material from said source of coating material and to contact said printing plate in a nip formed between said plate and impression cylinders such that said inked image offsets onto said film, and wherein said film of said coating material is transferable with said inked image from said image transfer belt onto the substrate to provide protection or a desired finishing to said inked image; and f) an image transfer belt tensioning system configured to register said image transfer belt to said impression cylinder positioned in the area of desired image transfer.

15. An offset printing system as claimed in claim 14 further comprising a sensing device for sensing the position of said image transfer belt.

16. An offset printing system as claimed in claim 14 wherein said image transfer belt comprises at least one base ply, at least one layer of a compressible material over said base ply, and a surface ply over said layer of compressible material.

17. An offset printing system as claimed in claim 16 wherein said image transfer belt is continuous.

18. An offset printing system as claimed in claim 16 wherein said base ply comprises a reinforcement material.

19. An offset printing system as claimed in claim 18 wherein said reinforcement material comprises a woven fabric ply.

20. An offset printing system as claimed in claim 19 wherein said woven fabric ply is rigid in a direction across the width of said belt and flexible along the longitudinal axis of said belt.

21. An offset printing system as claimed in claim 16 wherein said base ply includes an inner surface which is capable of providing precise registration.

22. An offset printing system as claimed in claim 21 wherein said inner surface comprises a high friction material.

23. An offset printing system as claimed in claim 14 further comprising a second source of ink; a second source of a transparent polymeric material; a second plate cylinder adapted have thereon a second printing plate, said second printing plate adapted to receive ink from said second ink source to form an inked image; a second impression cylinder; a second image transfer belt positioned to receive a film of transparent polymeric material from said source of transparent polymeric material and to contact said second printing plate in a nip formed between said second printing plate and said second impression cylinder such that said inked image offsets to said film; and a second image transfer belt tensioning system adapted to register said second image transfer belt to said second impression cylinder positioned in the area of desired image transfer, said area of desired image transfer being in opposition to the first image transfer belt to effect two-sided printing of a moving substrate.

24. An offset printing system as claimed in claim 14 wherein said ink from said ink source is selected from the group consisting of waterbased, waterless, and UV inks.

25. An offset printing system as claimed in claim 14 wherein said coating material is a transparent polymeric material.

26. An offset printing system as claimed in claim 14 further comprising an image belt cleaning station adapted to remove residual material from the surface of said image transfer belt after image transfer of said inked image and film from said image transfer belt to a substrate.

27. An offset printing system as claimed in claim 14 wherein said at least one impression cylinder has an outer diameter unequal to an outer diameter of said replaceable sleeve.

28. An offset printing system as claimed in claim 14 wherein said image transfer belt tensioning system including a drive and tension rollers, wherein at least one of said tension rollers is temperature controlled to minimize contraction and expansion of said image transfer belt.

29. An offset printing system for printing onto a substrate, said offset printing system comprising:

a) at least two sources of ink having at least first and second different colors;

b) at least two plate cylinders adapted to have thereon a respective replaceable sleeve providing a printing plate adapted to receive ink from one of said at least two sources of ink;

c) at least two impression cylinders, each of said at least two impression cylinders having an outer diameter unequal to an outer diameter of said respective replaceable sleeve;

d) an image transfer belt positioned to contact each of said printing plates at respective nips formed between respective ones of said plate cylinders and said impression cylinders and to receive in registration at least first and second inked images from said printing plates to form a multi-colored image on a first side of said image transfer belt;

e) an image transfer belt tensioning system adapted to register said image transfer belt to respective ones of said impression cylinders positioned in the area of desired image transfer and having tension rollers, wherein at least one of said tension rollers is temperature controlled to minimize contraction and expansion of said image transfer belt;

f) a coating station adapted to apply a film of a coating material to said first side of said image transfer belt, and wherein said film of said coating material is transferable with said multi-colored image from said image transfer belt onto the substrate to provide protection or a desired finishing to said multi-colored image; and g) an image belt cleaning station adapted to remove residual material from the surface of said mage transfer belt after image transfer of said multi-colored image and film from said image transfer belt to the substrate.

* * * * *

UNITED STATES PATENT AND TRADEMARK OFFICE

CERTIFICATE OF CORRECTION

PATENT NO. : 7,066,088 B2
APPLICATION NO. : 10/208997
DATED : June 27, 2006
INVENTOR(S) : McLean et al.

It is certified that error appears in the above-identified patent and that said Letters Patent is hereby corrected as shown below:

Col. 10, line 38 “bell” should read --belt--; and
Col. 13, line 4 “mage” should read --image--.

Signed and Sealed this

Twelfth Day of December, 2006

JON W. DUDAS
*Director of the United States Patent and Trademark Office*